US007338300B1

(12) United States Patent
Chang et al.

(10) Patent No.: US 7,338,300 B1
(45) Date of Patent: Mar. 4, 2008

(54) STATIC ELECTRICITY CONDUCTIVE MECHANISM

(75) Inventors: Lin-Wei Chang, Taipei (TW); Yi-Chun Shih, Taipei (JP)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/605,564

(22) Filed: Nov. 28, 2006

(51) Int. Cl.
*H01R 12/00* (2006.01)

(52) U.S. Cl. ..... 439/86; 439/95; 439/939

(58) Field of Classification Search ..... 439/66, 439/74, 86, 95, 939
See application file for complete search history.

(56) References Cited

U.S. PATENT DOCUMENTS 4,793,814 A * 12/1988 Zifcak et al. ..... 439/66
5,049,084 A * 9/1991 Bakke ..... 439/66
5,309,324 A * 5/1994 Herandez et al. ..... 361/734
5,735,698 A * 4/1998 Bakker et al. ..... 439/91
5,791,914 A * 8/1998 Loranger et al. ..... 439/71
6,049,468 A * 4/2000 Learmonth ..... 361/816
6,452,406 B1 * 9/2002 Beaman et al. ..... 324/754
7,167,010 B2 * 1/2007 Hembree ..... 324/754
2002/0190738 A1 * 12/2002 Beaman et al. ..... 324/754
2006/0035482 A1 * 2/2006 Yasumura et al. ..... 439/65

* cited by examiner

*Primary Examiner*—Neil Abrams
*Assistant Examiner*—Phuongchi Nguyen
(74) *Attorney, Agent, or Firm*—Peter F. Corless; Steven M. Jensen; Edwards Angell Palmer & Dodge LLP

(57) ABSTRACT

The present invention discloses a static electricity conductive mechanism including a plurality of conductive bumps and conductive members, for conducting static electricity generated by a connector device to a base thereof, the connector device having a connector body disposed on a circuit board, and the base being ground to earth. The conductive bumps of the static electricity conductive mechanism are each disposed on the base. The conductive members are disposed between the connector body and the conductive bumps. The conductive members conduct to the conductive bumps the static electricity generated by the connector body, thus conducting to earth the static electricity generated by the connector body. The prior art involves disposing a resilient element between a connector's body and base and thereby results in poor contact and poor conduction of static electricity between the body and the base. The drawback is solved by the present invention.

6 Claims, 3 Drawing Sheets

STATIC ELECTRICITY CONDUCTIVE MECHANISM

BACKGROUND OF THE INVENTION

1. Field of the Invention

The present invention relates to a static electricity conductive mechanism, and more particularly, to a static electricity conductive mechanism for providing protection by discharging static electricity generated by a connector device.

2. Description of the Prior Art

Referring to FIG. 1, which is a schematic view showing the structure of a conventional connector conductive device, the conventional connector conductive device comprises a body 30, a plurality of resilient elements 31, and a base 32 (for example, a base of a server or an electronic device). The plurality of resilient elements 31 are leaf springs each disposed on the base 32 and corresponding in position to the body 30 such that the body 30 is in contact with the base 32 via the resilient elements 31. In so doing, static electricity generated by the connector is conducted to the base 32 for protective electrostatic discharge.

However, it is through the resilient elements 31 does the body 30 of the aforesaid connector conductive device come in contact with the base 32. In addition, the resilient elements 31 are susceptible to poor contact and thus conduction of static electricity between the body 30 and the base 32 decreases.

Accordingly, an issue calling for urgent solution involves providing a connector conductive device characterized by large conductive area and enhanced conduction of static electricity.

SUMMARY OF THE INVENTION

In light of the aforesaid drawbacks of the prior art, it is a primary objective of the present invention to provide a static electricity conductive mechanism for protective discharge of static electricity generated by a connector device.

In order to achieve the above and other objectives, the present invention provides a static electricity conductive mechanism comprising a plurality of conductive bumps and conductive members, for conducting static electricity generated by a connector device to a base thereof with a view to performing protective electrostatic discharge. The connector device comprises a connector body disposed on a circuit board. The base is grounded to earth.

The conductive bumps are each disposed on the base. The conductive bumps are directly formed on the base by half shearing. The conductive members are disposed between the connector body and the conductive bumps for connection with the conductive bumps. The conductive members directly conduct to the conductive bumps the static electricity generated by the connector body, thus achieving protective electrostatic discharge. The prior art involves disposing a resilient element between a connector's body and base and thereby results in poor contact and poor conduction of static electricity between the body and the base. The drawback is solved by the present invention.

A static electricity conductive mechanism of the present invention comprises conductive bumps and conductive members, wherein the conductive bumps are directly formed on a base, and the conductive members are disposed between a connector body and the conductive bumps, such that the conductive bumps are in direct contact with the conductive members. Accordingly, the conductive members directly conduct to the conductive bumps the static electricity generated by the connector body, thus achieving protective electrostatic discharge. The prior art involves disposing a resilient element between a connector's body and base and thereby results in poor contact and poor conduction of static electricity between the body and the base. The drawback is solved by the present invention.

DETAILED DESCRIPTION OF THE PREFERRED EMBODIMENTS

The following specific embodiments are provided to illustrate the present invention. Others ordinarily skilled in the art can readily gain an insight into other advantages and features of the present invention based on the contents disclosed in this specification.

Figure 1:
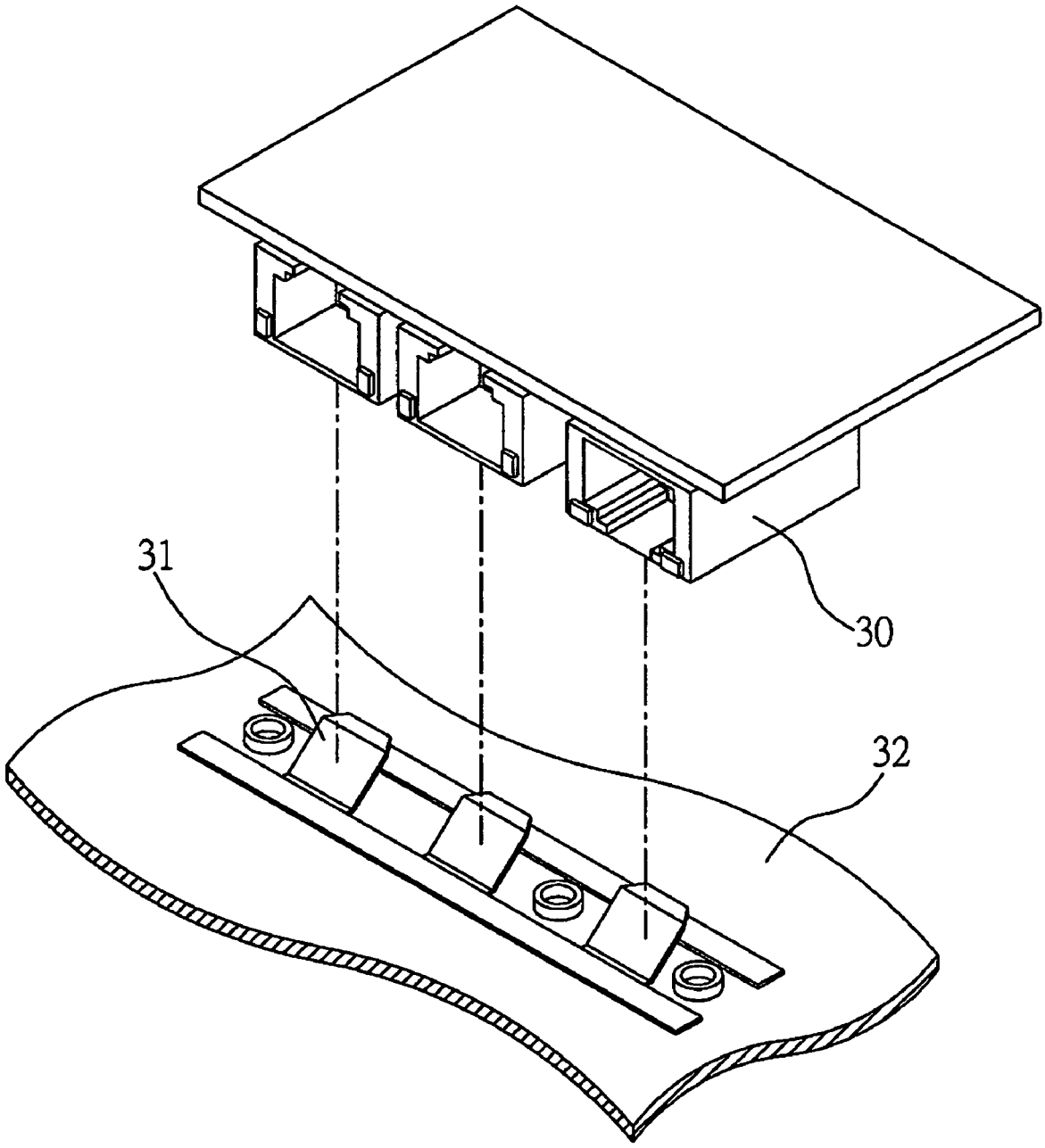
FIG. 1 (PRIOR ART)
FIG. 1 (PRIOR ART) is a schematic view showing the structure of a conventional connector conductive device.
Figure 2:
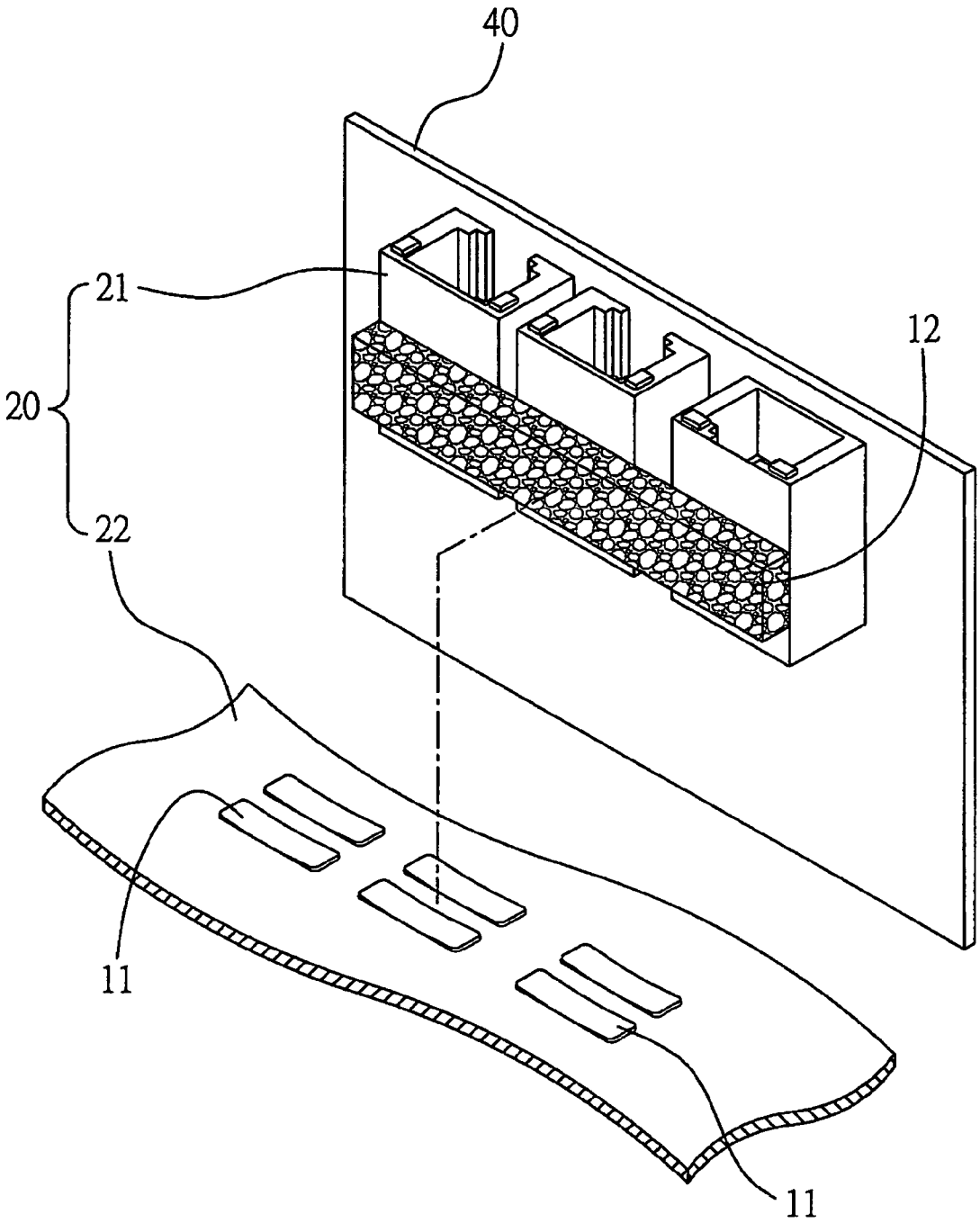
FIG. 2 is a schematic view showing a static electricity conductive mechanism of the present invention.

Referring to FIG. 2, which is a schematic view showing a static electricity conductive mechanism of the present invention, the static electricity conductive mechanism conducts static electricity generated by a connector device 20 to a base 22 (for example, a supporting board or a casing) thereof, for protective electrostatic discharge. The static electricity conductive mechanism comprises a plurality of conductive bumps 11 and conductive members 12. The connector device 20 comprises a connector body 21. The connector body 21 is disposed on a circuit board 40. The base 22 is grounded to earth.

Disposed on the base 22, each of the conductive bumps 11 is half-sheared with a special mold (for example, a half-shear mold) during a fabrication process. The conductive bumps 11 and the base 22 are combined to form a single integral piece. It is also feasible to directly form the conductive bumps 11 on the base 22 by half shearing.

The conductive members 12 are conductive foam disposed between the connector body 21 and the conductive bumps 11, for connection with the conductive bumps 11. In this embodiment, the half-sheared conductive bumps 11 are directly formed on the base 22. The conductive foam (that is, the conductive members 12) is uniformly glued to the connector body 21. The conductive bumps 11 on the base 22 are in direct contact with the conductive foam glued to the connector body 21. Hence, the conductive foam directly conducts to the conductive bumps 11 the static electricity generated by the connector body 21 with a view to performing protective electrostatic discharge. The prior art involves disposing a resilient element between a connector's body and base and thereby results in poor contact and poor conduction of static electricity between the body and the base. The drawback is solved by the present invention.

Figure 3:
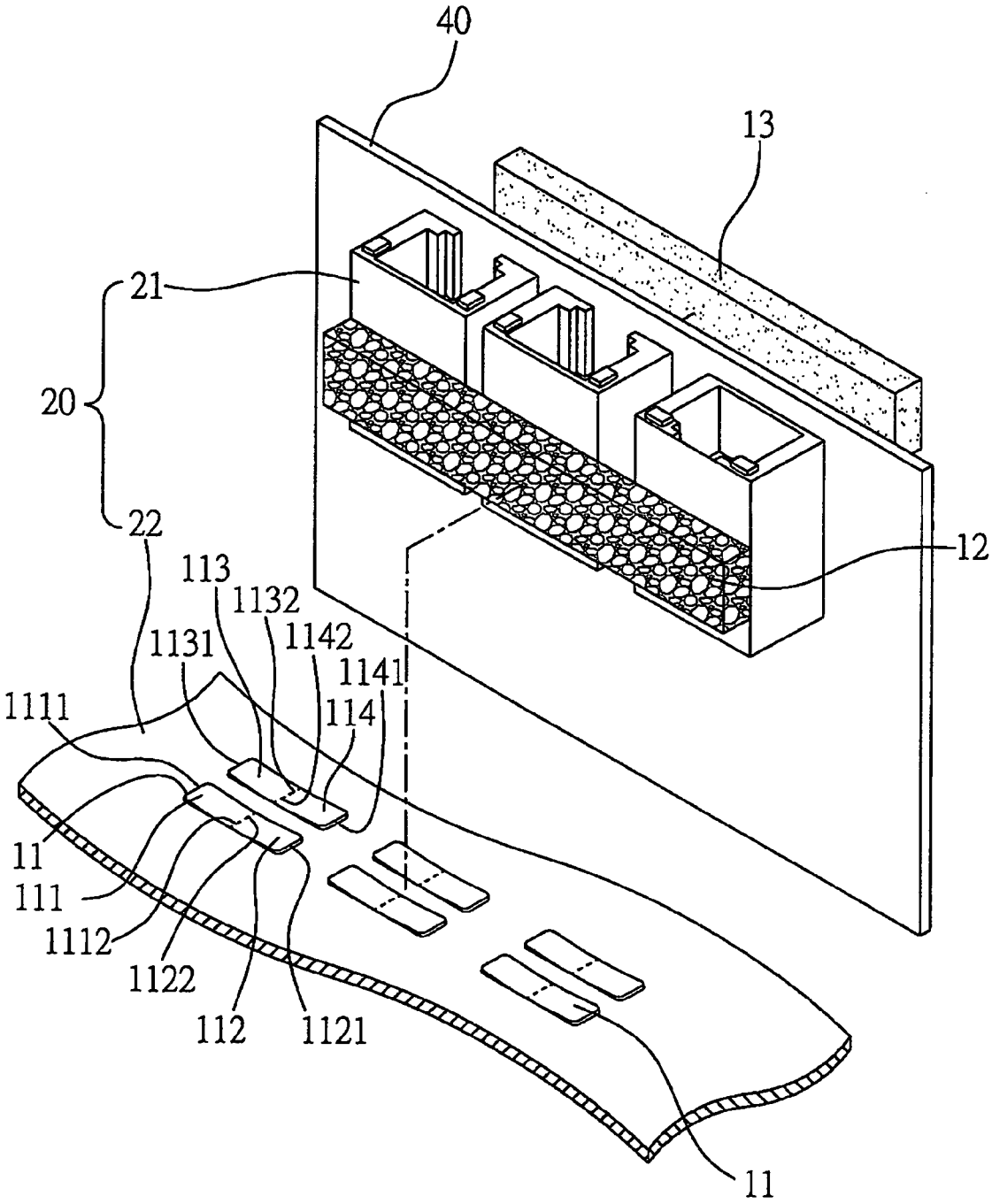
FIG. 3 is a schematic view showing another static electricity conductive mechanism of the present invention.

Referring to FIG. 3, which is a schematic view showing another structure of a static electricity conductive mechanism of the present invention, a static electricity conductive mechanism of this embodiment mainly differs from that of the preceding embodiment in that this embodiment discloses a static electricity conductive mechanism further comprising a binder 13 disposed between an upper cover (or a blocking plate) of an electronic device and the circuit board 40. Pressing the upper cover on the circuit board 40 sets the circuit board 40, the conductive members 12, and the conductive bumps 11 at a tight state. The binder 13 has binding capacity and is exemplified by a rubber spacer.

In this embodiment, the conductive bumps 11 include a first rectangular half-shorn conductive bump 111, a second rectangular half-shorn conductive bump 112, a third rectangular half-shorn conductive bump 113 parallel to the first rectangular half-shorn conductive bump 111, and a fourth rectangular half-shorn conductive bump 114 parallel to the third rectangular half-shorn conductive bump 113, all of which are directly formed on the base 22, and the conductive foam (that is, the conductive members 12) is uniformly glued to the connector body 21. Gluing uniformly the conductive foam to the connector body 21 increases the electrical contact area of the conductive foam, and thus the static electricity generated by the connector body 20 can be rapidly conducted to the base 22.

As shown in FIG. 3, the first rectangular half-shorn conductive bump 111 has a first shorn conductive portion 1111 and a first unshorn conductive portion 1112 connected to the first shorn conductive portion 1111; the second rectangular half-shorn conductive bump 112 has a second shorn conductive portion 1121 and a second unshorn conductive portion 1122 connected between the second shorn conductive portion 1121 and the first unshorn conductive portion 1112; the third rectangular half-shorn conductive bump 113 has a third shorn conductive portion 1131 and a third unshorn conductive portion 1132 connected to the third shorn conductive portion 1131; the fourth rectangular half-shorn conductive bump 114 has a fourth shorn conductive portion 1141 and a fourth unshorn conductive portion 1142 connected between the fourth shorn conductive portion 1141 and the third unshorn conductive portion 1132.

In this embodiment, the first, second, third and fourth rectangular half-shorn conductive bumps 111, 112, 113 and 114 occupy on the base 22 an area smaller than a cross section of the conductive member 12. Therefore, the conductive member 12, when being in contact with the first, second, third and fourth rectangular half-shorn conductive bumps 111, 112, 113 and 114, covers the first, second, third and fourth rectangular half-shorn conductive bumps 111, 112, 113 and 114 completely, so the completely covered first, second, third and fourth rectangular half-shorn conductive bumps 111, 112, 113 and 114 will neither be in contact with other electronic components on the base 22 nor affect the operations of the electronic components.

A static electricity conductive mechanism of the present invention comprises a plurality of conductive bumps and conductive members, for conducting static electricity generated by a connector device to a base thereof. The connector device comprises a connector body disposed on a circuit board. The base is grounded to earth. The plurality of conductive bumps are each disposed on the base. The conductive members are disposed between the connector body and the conductive bumps. Upon connection of the conductive bumps and the conductive members, the conductive members conduct to the conductive bumps static electricity generated by the connector body, thus conducting the static electricity to the base. As a result, the static electricity generated by the connector body is conducted to earth. The prior art involves disposing a resilient element between a connector's body and base and thereby results in poor contact and poor conduction of static electricity between the body and the base. The drawback is solved by the present invention.

The aforesaid embodiments merely serve as the preferred embodiments of the present invention. They should not be construed as to limit the scope of the present invention in any way. Hence, any other changes can actually be made in the present invention. It will be apparent to those skilled in the art that all equivalent modifications or changes made, without departing from the spirit and the technical concepts disclosed by the present invention, should fall within the scope of the appended claims.

What is claimed is:

1. A static electricity conductive mechanism for conducting static electricity generated by a connector device to a base of an electronic device, the connector device having a connector body disposed on a circuit board of the electronic device, the base being grounded to earth, the static electricity conductive mechanism comprising:

a plurality of conductive bumps each disposed on the base; and a conductive member disposed between the connector body and the conductive bumps, wherein each of the conductive bumps is connected with the conductive member such that the conductive member conducts to the conductive bumps the static electricity generated by the connector body, thus conducting to earth the static electricity generated by the connector body.

2. The static electricity conductive mechanism of claim 1, wherein the plurality of conductive bumps are formed by half shearing.

3. The static electricity conductive mechanism of claim 1, wherein the plurality of conductive bumps and the base are combined to form a single integral piece.

4. The static electricity conductive mechanism of claim 1, wherein the conductive member is a conductive foam.

5. A static electricity conductive mechanism for conducting static electricity generated by a connector device to a base thereof, the connector device having a connector body disposed on a circuit board, the base being grounded to earth, the static electricity conductive mechanism comprising:

a first rectangular half-shorn conductive bump disposed on the base, the first rectangular half-shorn conductive bump having a first shorn conductive portion and a first unshorn conductive portion connected to the first shorn conductive portion;

a second rectangular half-shorn conductive bump disposed on the base, the second rectangular half-shorn conductive bump having a second shorn conductive portion and a second unshorn conductive portion connected between the second shorn conductive portion and the first unshorn conductive portion;

a third rectangular half-shorn conductive bump disposed on the base and parallel to the first rectangular half-shorn conductive bump, the third rectangular half-shorn conductive bump having a third shorn conductive portion and a third unshorn conductive portion connected to the third shorn conductive portion;

a fourth rectangular half-shorn conductive bump disposed on the base and parallel to the second rectangular half-shorn conductive bump, the fourth rectangular half-shorn conductive bump having a fourth shorn conductive portion and a fourth unshorn conductive portion connected between the fourth shorn conductive portion and the third unshorn conductive portion; and a conductive member disposed between the connector body and the first, second, third and fourth rectangular half-shorn conductive bumps, for connection with the first, second, third and fourth rectangular half-shorn conductive bumps, such that the conductive member conduct to the first, second, third and fourth rectangular half-shorn conductive bumps the static electricity generated by the connector body, thus conducting to earth the static electricity generated by the connector body.

6. The static electricity conductive mechanism of claim 5, wherein the first, second, third and fourth rectangular half-shorn conductive bumps occupy on the base an area smaller than a cross section of the conductive member.

* * * * *